US009252470B2

(12) United States Patent
Khanna et al.

(10) Patent No.: US 9,252,470 B2
(45) Date of Patent: Feb. 2, 2016

(54) ULTRA-BROADBAND DIPLEXER USING WAVEGUIDE AND PLANAR TRANSMISSION LINES

(71) Applicant: NATIONAL INSTRUMENTS CORPORATION, Ausin, TX (US)

(72) Inventors: Amarpal S. Khanna, San Jose, CA (US); Irfan Ashiq, Dublin, CA (US)

(73) Assignee: National Instruments Corporation, Austin, TX (US)

( * ) Notice: Subject to any disclaimer, the term of this patent is extended or adjusted under 35 U.S.C. 154(b) by 161 days.

(21) Appl. No.: 14/029,294

(22) Filed: Sep. 17, 2013

(65) Prior Publication Data

US 2015/0077195 A1 Mar. 19, 2015

(51) Int. Cl.
*H01P 1/213* (2006.01)
*H01P 5/12* (2006.01)

(52) U.S. Cl.
CPC ..... *H01P 1/213* (2013.01); *H01P 1/2135* (2013.01); *H01P 1/2138* (2013.01); *H01P 5/12* (2013.01)

(58) Field of Classification Search
CPC ..... H01P 1/213; H01P 1/2135; H01P 1/2138; H01P 5/12
USPC ..... 333/134–135
See application file for complete search history.

(56) References Cited

U.S. PATENT DOCUMENTS 3,879,690 A * 4/1975 Golant et al. ..... 333/204
4,498,061 A * 2/1985 Morz et al. ..... 333/21 A
6,008,706 A 12/1999 Holme et al.
6,917,256 B2 7/2005 Emrick et al.
7,332,982 B2 2/2008 Yun et al.
2006/0145782 A1 * 7/2006 Liu et al. ..... 333/132
2007/0139135 A1 6/2007 Ammar et al.
2011/0254640 A1 10/2011 Gehring et al.
2013/0002373 A1 1/2013 Robert et al.

FOREIGN PATENT DOCUMENTS

EP 1170818 A2 9/2002
EP 1492194 A1 12/2004

OTHER PUBLICATIONS

Rehner, R., et al.; "A Quasi-Lumped Ultra-Broadband Contiguous SSL-Diplexer from DC to 80 GHz"; Microwave Symposium Digest, 2009; Jun. 7-12, 2009; MTT '09; IEEE MTT-S International; pp. 1037-1040.
Manchec, A., et al; "High Rejection Planar Diplexer on Liquid Crystal Polymer Substrates Using Oversizing Techniques"; Microwave Conference, 2005 European (vol. 1); Oct. 4-6, 2005; 4 pages.
Menzel, W., et al.; "Planar Integrated Waveguide Diplexer for Low-Loss Millimeter-Wave Applications"; Microwave Conference, 1997; 27th European (vol. 2); Sep. 8-12, 1997; pp. 676-680.

* cited by examiner

*Primary Examiner* — Benny Lee
*Assistant Examiner* — Albens Dieujuste
(74) *Attorney, Agent, or Firm* — Meyertons Hood Kivlin Kowert & Goetzel, P.C.; Jeffrey C. Hood

(57) ABSTRACT

A hybrid diplexer combining planar transmission line(s) and a waveguide is disclosed. In one embodiment, a diplexer includes first, second, and third ports. The diplexer also includes a first signal path and a second signal path. The first signal path may be used to convey lower frequencies, and may be implemented using planar transmission lines. The second signal path may be used to convey higher frequencies, and may be implemented, at least in part, using a waveguide. The first signal path may be coupled between the first port and the second port, while the second signal path may be coupled between the first port and the third port. In one embodiment, the first signal path may implement a low-pass filter, while the second signal path may implement a high-pass filter.

38 Claims, 7 Drawing Sheets

ULTRA-BROADBAND DIPLEXER USING WAVEGUIDE AND PLANAR TRANSMISSION LINES

BACKGROUND

1. Technical Field

This disclosure relates to transmission line filters, and more particularly, to broadband diplexers.

2. Description of the Related Art

Diplexers are well known in the electronic arts. A diplexer is a passive component that performs frequency division multiplexing between a low frequency band and a high frequency band. As such, a diplexer may include a low-pass filter and a high-pass filter. Alternatively, at least one of the filters may be implemented as a bandpass filter. Depending on how a particular diplexer is connected, it may multiplex two ports onto a single port, or may demultiplex one port onto two different ports.

A wide variety of applications exist for diplexers. For example, diplexers may be used in communications systems, e.g., to separate an incoming broadband signal into two separate broadband signals each within its own, unique range of frequencies. In another application, a diplexer may be used to combine signals on an input to a wideband oscilloscope in, e.g., a laboratory environment.

SUMMARY OF THE DISCLOSURE

A hybrid diplexer implemented using both planar transmission lines and waveguides is disclosed. In one embodiment, a diplexer includes an input configured to receive a broadband signal, a low-pass filter, and a high-pass filter. The low-pass filter may be implemented using a planar transmission line. The high-pass filter may be implemented using a waveguide. Accordingly, as disclosed herein, a planar transmission line and a waveguide are implemented within a single diplexer.

In one embodiment, a method includes receiving a broadband signal at an input of a diplexer. The method further includes low-pass filtering the broadband signal using a low-pass filter implemented in the diplexer using a planar transmission line. The method further includes high-pass filtering the broadband signal using a high-pass filter implemented in the diplexer using a waveguide.

Another embodiment of a diplexer includes first, second, and third ports to provide interfaces to the external world. A first signal path is implemented between the first port and the second port, using a planar transmission line. A second signal path is implemented between the first port and the third port using a waveguide.

In general, a diplexer as implemented herein includes a low frequency signal path implemented using a planar transmission line. The low frequency signal path does not include any portion implemented as a waveguide. The diplexer as implemented herein also includes a high frequency signal path implemented as a waveguide. A portion of the high frequency signal path may include a planar transmission line(s), which may be used as a transitional medium between a port or ports coupled to the high frequency signal path and the waveguide. In one embodiment, the various ports may be implemented using coaxial transmission lines. However, an embodiment is also possible and contemplated wherein a port coupled to the high frequency signal path is a waveguide port (e.g., a waveguide output).

BRIEF DESCRIPTION OF THE DRAWINGS

Other aspects of the disclosure will become apparent upon reading the following detailed description and upon reference to the accompanying drawings, which are now described as follows.

Figure 1A:
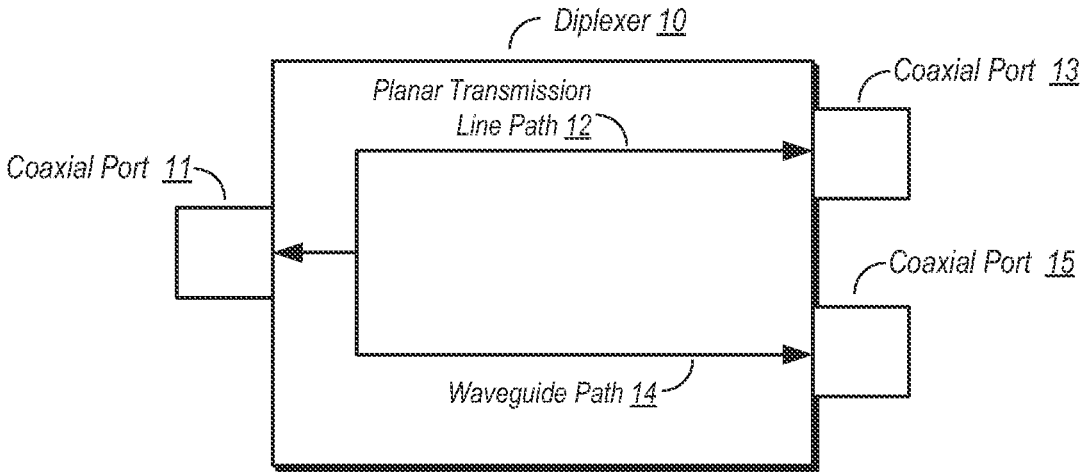
FIG. 1A is a block diagram illustrating one embodiment of a diplexer.

While the subject matter disclosed herein is susceptible to various modifications and alternative forms, specific embodiments thereof are shown by way of example in the drawings and will herein be described in detail. It should be understood, however, that the drawings and description thereto are not intended to be limiting to the particular form disclosed, but, on the contrary, is to cover all modifications, equivalents, and alternatives falling within the spirit and scope of the present disclosure as defined by the appended claims. The headings used herein are for organizational purposes only and are not meant to be used to limit the scope of the description. As used throughout this application, the word "may" is used in a permissive sense (i.e., meaning having the potential to), rather than the mandatory sense (i.e., meaning must). Similarly, the words "include", "including", and "includes" mean including, but not limited to.

Various units, circuits, or other components may be described as "configured to" perform a task or tasks. In such contexts, "configured to" is a broad recitation of structure generally meaning "having circuitry that" performs the task or tasks during operation. As such, the unit/circuit/component can be configured to perform the task even when the unit/circuit/component is not currently on. In general, the circuitry that forms the structure corresponding to "configured to" may include hardware circuits. Similarly, various units/circuits/components may be described as performing a task or tasks, for convenience in the description. Such descriptions should be interpreted as including the phrase "configured to." Reciting a unit/circuit/component that is configured to perform one or more tasks is expressly intended not to invoke 35 U.S.C. §112, paragraph six interpretation for that unit/circuit/component.

DETAILED DESCRIPTION

Turning now to FIG. 1A, a block diagram of one embodiment of a diplexer is shown. In the embodiment shown, diplexer 10 includes a first coaxial port 11, a second coaxial port 13, and a third coaxial port 15 (each of which may be coupled to, e.g., corresponding external coaxial cables). A first signal path 12, implemented using a planar transmission line, is coupled between coaxial port 11 and coaxial port 13. A second signal path 14, implemented at least in part using a waveguide, is coupled between coaxial port 11 and coaxial port 15.

In one embodiment, coaxial port 11 may be used as an input, while coaxial ports 13 and 15 are used as outputs. Moreover, first signal path 12 may implement a low-pass filter constructed of a planar transmission line. The planar transmission line may be a suspended strip line (SSL) in one embodiment, but may be implemented as a microstrip transmission line in another embodiment. The second signal path 14 may implement a high-pass filter using the waveguide. In one embodiment, the waveguide may be a transverse electric (TE) mode E-plane waveguide.

The respective ranges of signal frequencies passed by the low-pass and high-pass filters may be non-overlapping in some embodiments, with the low cutoff frequency of the high-pass filter being greater than the high cutoff frequency of the low-pass filter. In another embodiment, the respective ranges of signal frequencies passed by the low- and high-pass filters may overlap or coincide, and thus the diplexer may pass signals from an overall larger contiguous range of frequencies.

It is noted that the second signal path 14 may in some embodiments include some planar transmission lines to couple the waveguide to coaxial ports 11 and 15. However, these planar transmission lines are arranged in such a manner to pass as much of the spectrum of a received signal as possible to the waveguide of second signal path 14, as will be explained in further detail below.

While the embodiment shown in FIG. 1A is discussed in the context of coaxial port 11 being an input port and coaxial ports 13 and 15 being output ports, it is noted that such a description is not intended to be limiting. Accordingly, embodiments in which coaxial ports 13 and 15 are used as input ports, while coaxial port 11 is used as an output port are also possible an contemplated. Generally speaking, diplexer 10 in the various embodiments discussed herein may be used as a splitter or as a combiner, with the various ports utilized accordingly.

Figure 1B:
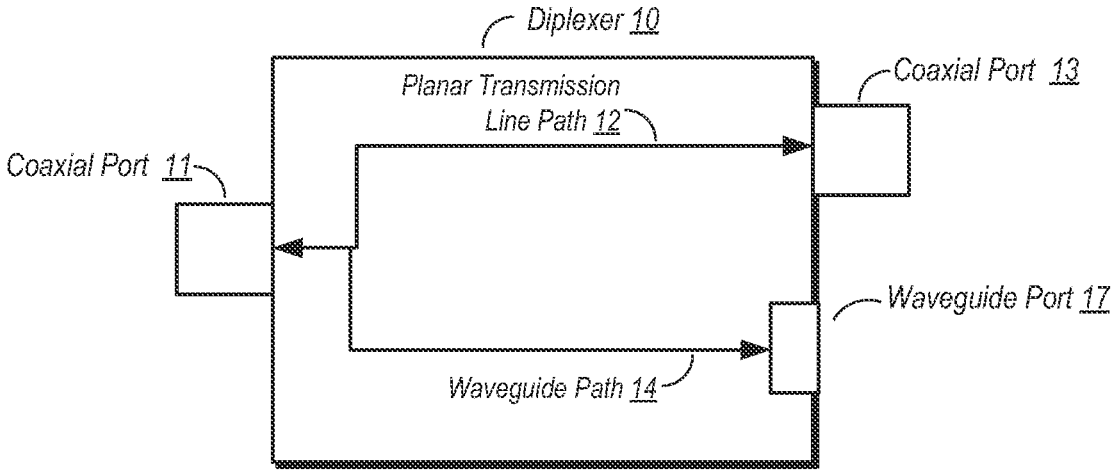
FIG. 1B is a block diagram illustrating another embodiment of a diplexer.

FIG. 1B illustrates another embodiment of diplexer 10. In the embodiment shown, diplexer 10 is largely similar to the embodiment shown in FIG. 1A. However, in the embodiment of FIG. 1B, coaxial port 15 has been replaced by a waveguide port 17. Thus, diplexer 10 includes one port that may be used as a waveguide input or output, and which may be coupled to a corresponding waveguide.

Figure 2:
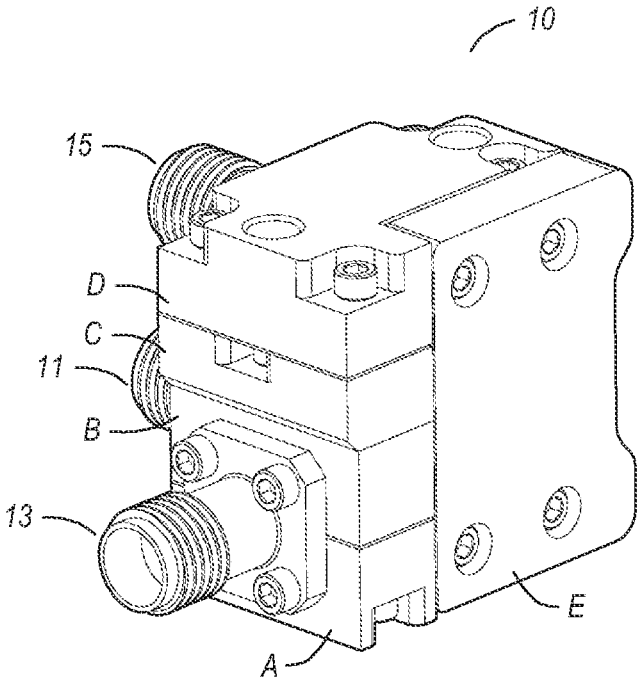
FIG. 2 illustrates a first view of one embodiment of a diplexer.
Figure 3:
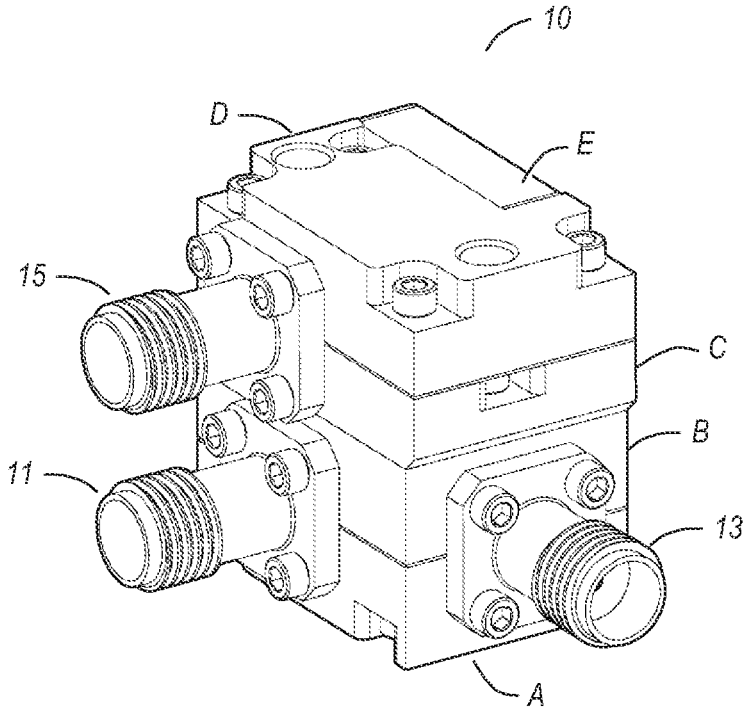
FIG. 3 illustrates another view of the diplexer of FIG. 2.

FIGS. 2 and 3 are two different views of one embodiment of a fully assembled diplexer 10 according to the disclosure herein. In the embodiment illustrated in FIGS. 2-3, diplexer 10 includes coaxial ports 11, 13, and 15, which correspond to the same ports as illustrated in FIG. 1A. It is noted that embodiments having a waveguide port 17 in lieu of coaxial port 15 are possible and contemplated.

Diplexer 10 in the embodiment shown is an assembly of components A, B, C, D, and E, each of which will be discussed in further detail below. When assembled as shown, diplexer 10 is an ultra-broadband diplexer that includes a first signal path implemented using one or more planar transmission lines, and a second signal path that is implemented at least in part using a waveguide. The first signal path does not include any waveguide portions, and thus diplexer 10 combines a waveguide path and a planar transmission line path in the same unit. The first signal path may be used to convey signals in a lower frequency band, while the second signal path may convey signals in an upper frequency band. For example, in one embodiment, a first signal path may implement an ultra-wideband low-pass filter capable of passing signals in a range of frequencies from 0 Hz to 35 GHz, while the second signal path may implement an ultra-wideband filter capable of passing signals in a frequency range from 35 GHz up to at least 65 GHz. Thus, the overall frequency response of such an embodiment is within a contiguous range of frequencies from 0 Hz up to at least 65 GHz. It is noted however that the overall frequency range for other embodiments is not necessarily contiguous, and thus the upper cutoff frequency of the low-pass filter may be less than the lower cutoff frequency of the high-pass filter. Embodiments in which bandpass filters are implemented with one or both signal paths are also possible and contemplated, and the overall frequency range passed by the two paths collectively may or may not be contiguous, depending on the specific implementation.

Figure 4:
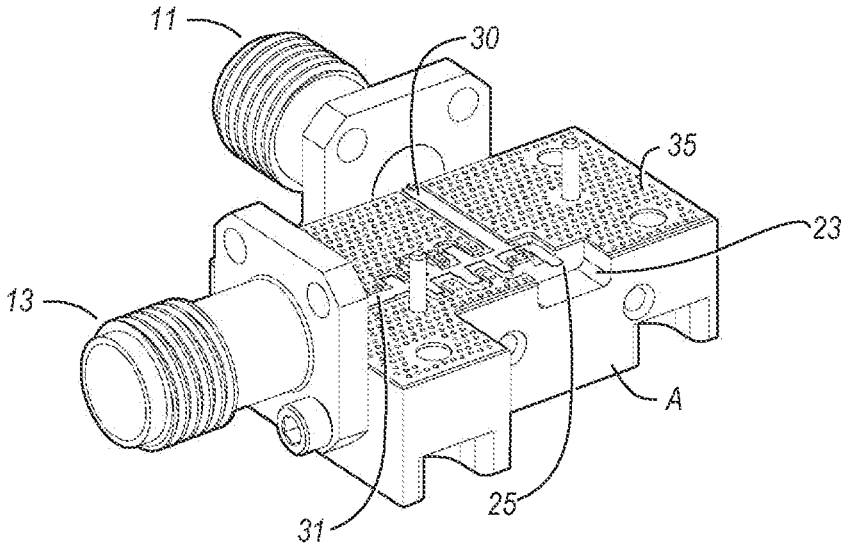
FIG. 4 illustrates an exemplary component A of the diplexer of FIG. 2 that implements a low-pass filter, according to one embodiment.
Figure 5:
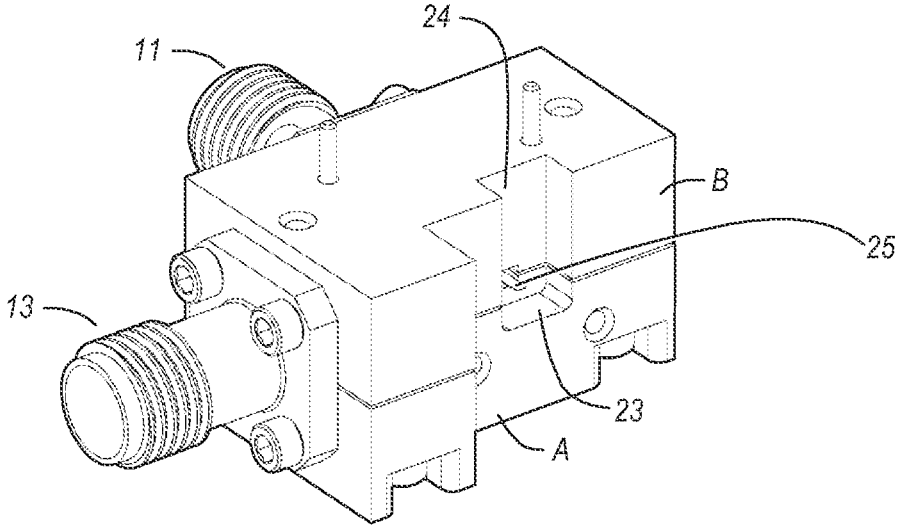
FIG. 5 illustrates attachment of the exemplary component A of the diplexer of FIG. 4 to another exemplary component B to implement a high-pass filter, according to one embodiment.

FIG. 4 illustrates component A of diplexer 10. Component A includes coaxial ports 11 and 13, and thus illustrates the first signal path implemented using a planar transmission line. The planar transmission line shown here includes two sections, section 30 and section 31. Section 31 of the planar transmission line may implement a low-pass filter, hence the stubs extending perpendicularly therefrom. Section 30, on the other hand, is arranged to pass as much of the received spectrum as possible. As shown in FIG. 5, component B attaches to component A. When attached in such a manner, sections 30 and 31 of the planar transmission line are implemented as suspended strip line (SSL) transmission lines. It is noted that embodiments in which these sections of planar transmission lines are implemented as microstrip transmission lines are possible and contemplated.

Section 30 of the planar transmission line in the embodiment shown is coupled to a section 31 of the planar transmission line. Section 31 includes a number of stubs extending perpendicularly from the main axis thereof, and thus implements a wideband low-pass filter. Section 30 is not implemented as a low-pass filter, instead passing as much energy across the spectrum of a received signal as possible. Sections 30 and 31 in the embodiment shown are implemented within printed circuit board 35. At the junction of sections 30 and 31, a waveguide stub 25 extends into waveguide backshort portion 23. Thus, waveguide stub 25 is a transition point from planar transmission line 30 to waveguide in this embodiment of diplexer 10.

FIG. 5 illustrates the attachment of component A to component B in diplexer 10. Component B includes an additional portion of waveguide 24, one end of which is defined by waveguide backshort 23 in component A. Waveguide stub 25 extends from component A in the portion where the latter is attached to component B. As arranged in this and the other drawings, waveguide 24 of diplexer 10 implements a high-pass filter.

Figure 6:
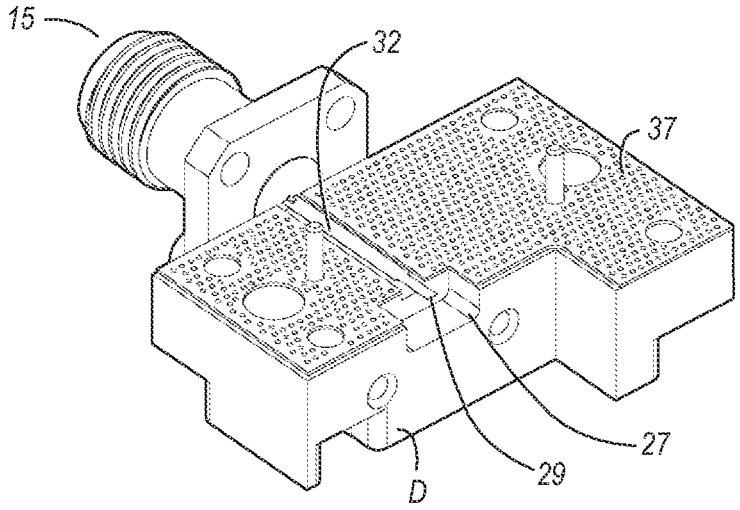
FIG. 6 illustrates another exemplary component D of the diplexer of FIG. 4 implementing waveguide portions, according to one embodiment.
Figure 7:
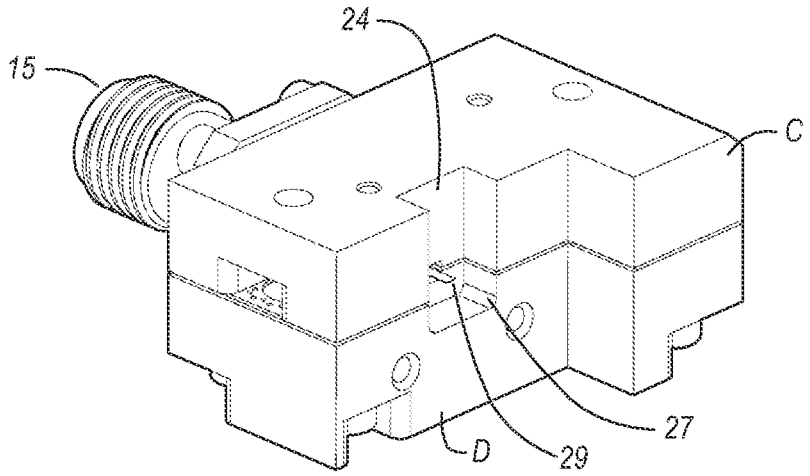
FIG. 7 illustrates attachment of the exemplary component D of the diplexer of FIG. 4 to another waveguide portion C to implement a planar transmission line as an SSL transmission line, according to one embodiment.

FIG. 6 illustrates component D of diplexer 10. Component D includes another waveguide backshort 27 that defines the other end of the waveguide when diplexer 10 is fully assembled. Additionally, component D also includes another waveguide stub 29, which extends from planar transmission line 32. Planar transmission line 32 in turn is coupled to coaxial port 15 in this particular embodiment. Component C is shown as being attached to component D in FIG. 7, thereby illustrating the attachment to another portion of waveguide 24 (with waveguide stub 29 extending into the waveguide). Planar transmission line 32 in this embodiment is implemented on PCB 37. When component C is attached to component D, planar transmission line 32 is implemented as an SSL transmission line.

Figure 8:
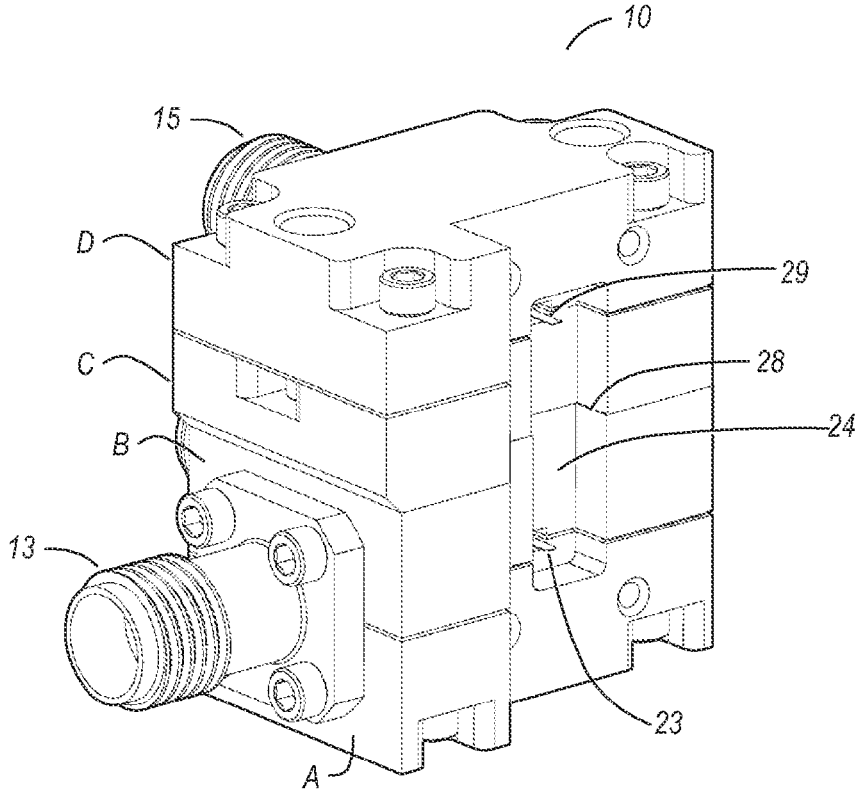
FIG. 8 illustrates the diplexer of FIG. 4 with assembled components A, B, C, and D, according to one embodiment.
Figure 9:
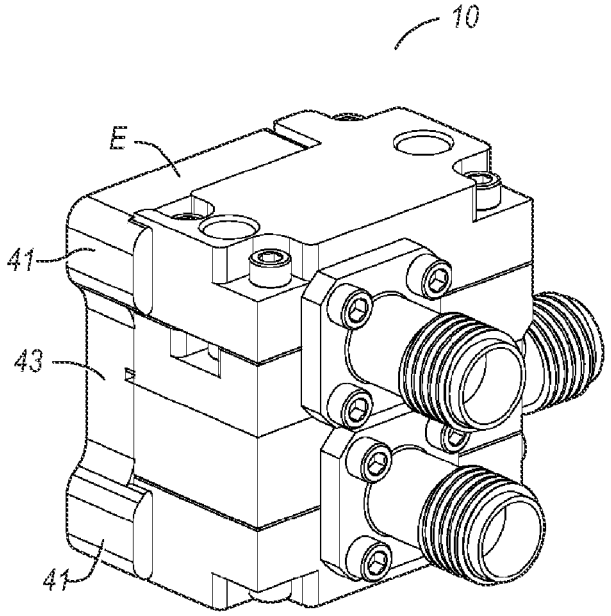
FIG. 9 illustrates the fully assembled exemplary diplexer of FIG. 4 with components A, B, C, and D, attached to component E to implement the waveguide, according to one embodiment.

FIG. 8 illustrates diplexer 10 with components A, B, C, and D attached to one another. In this drawing we can see the full extent of waveguide 24 as appearing in the final assembly of diplexer 10 (which is illustrated in both FIG. 2 and FIG. 9). A high-frequency portion of a broadband signal may be passed between waveguide stubs 23 and 29 through the air cavity that forms waveguide 24. In this embodiment, the width of waveguide 24 changes at waveguide channel transition plane 28, located the junction of components B and C. This transition may optimize the impedance encountered by signals pass through waveguide 24. FIG. 9 illustrates diplexer 10 with component E attached to components A, B, C, and D, and thus forming the final boundary over the air cavity that forms waveguide 24. Component E includes shoulders 41 and indent 43, which aid in the proper placement and orientation to the other components of diplexer 10.

The implementation of both planar transmission lines and a waveguide in diplexer 10 may provide allow a wider range of frequencies to pass compared to diplexers that are implemented exclusively with planar transmission lines or exclusively with waveguides. A diplexer implemented exclusively with waveguides is not capable of reaching the lower frequencies all the way down to DC (0 Hz). Diplexers implemented exclusively with planar transmission lines may be unable to efficiently pass some of the higher frequencies that may otherwise pass through a waveguide. Nevertheless, implementation of a hybrid waveguide/planar transmission line diplexers as discussed herein may present challenges in terms of mechanical design and packaging that are not present with prior art diplexers. Accordingly, various embodiments of diplexer 10 as discussed herein overcome the problems of combining the two approaches, waveguide and planar transmission line, while providing the advantages of both.

Figure 10:
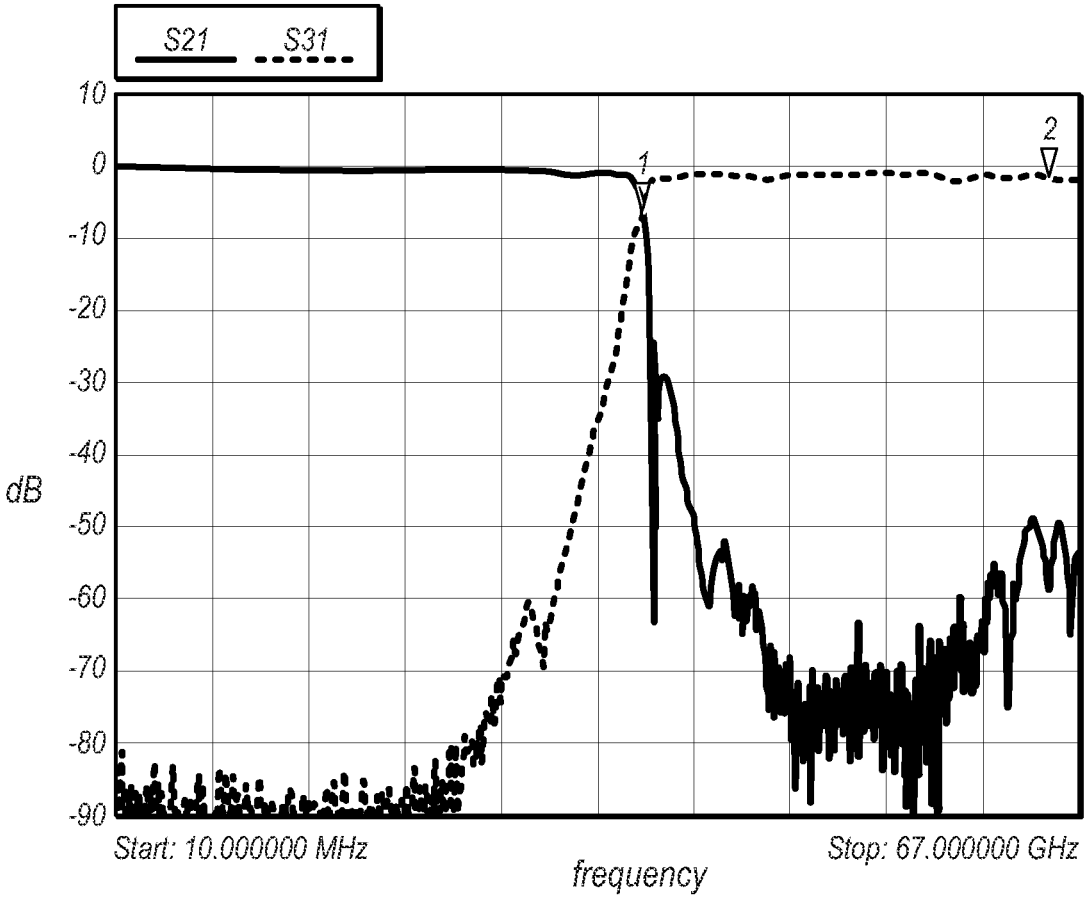
FIG. 10 is a graph illustrating the frequency response for one embodiment of a diplexer.

FIG. 10 is a graph illustrating the frequency response for one embodiment of diplexer 10. It is noted that this graph is exemplary and thus is not intended to be limiting for all embodiments of a diplexer 10 discussed herein. The graph shown herein is based on the input of an ultra-wideband signal that is passed to both a low-pass filter implemented with planar transmission lines and a high-pass filter implemented with a waveguide. The curve labeled S21 represents the output from the low-pass filter, while the curve labeled S31 represents the output from the high-pass filter. As can be seen in the drawing, the frequency response across the entire bandwidth is relatively stable, with a slight increase in attenuation at marker 1, where the respective cutoff frequencies of the low- and high-pass filters substantially coincide. Marker 1 in this particular example occurs at approximately 36 GHz, and occurs at crossover, i.e. the point where the two curves intersect. Marker 2 in the embodiment shown occurs at approximately 65 GHz. The overall frequency band output from the embodiment represented in FIG. 10 is largely contiguous up to at least 65 GHz, with one output providing the low-pass filtered portion while the other output provides the high-pass filtered portion. In other embodiments, additional separation between the filter cutoff frequencies may result in non-contiguous output bands.

Figure 11:
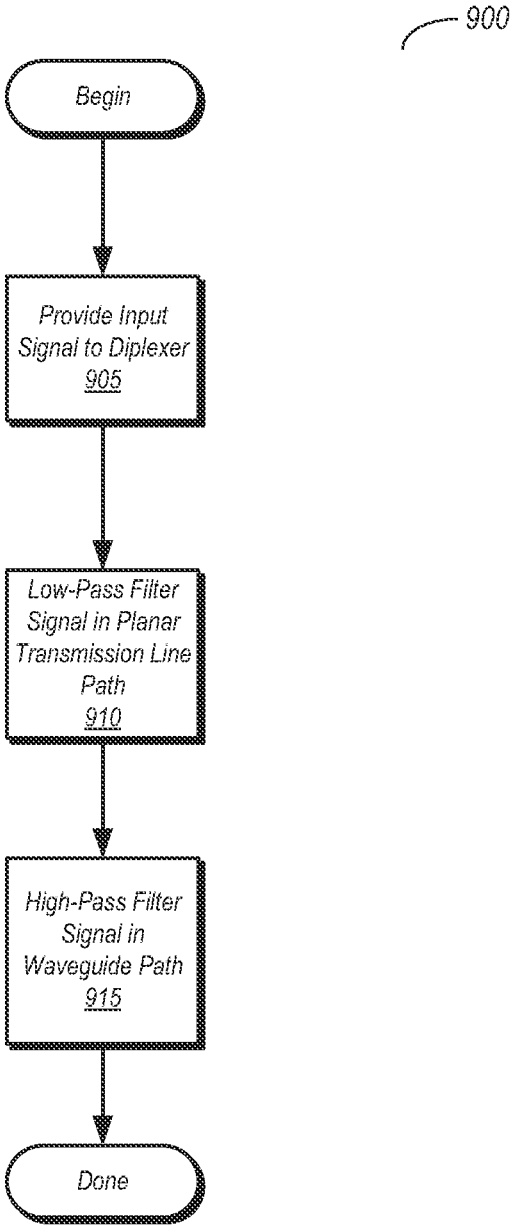
FIG. 11 is a flow diagram illustrating a method for operation of one embodiment of a diplexer.

Turning now to FIG. 11, one embodiment of a method for operation of one embodiment of a diplexer is shown as a flow diagram. Method 900 includes providing an input signal to a diplexer (block 905). The input signal may be a broadband signal, such as an ultra-wideband signal. The method further includes low-pass filtering the input signal in a portion of the diplexer implemented using planar transmission lines (block 910). The planar transmission lines may be SSL, microstrip, or any suitable planar transmission type. Method 900 further includes high-pass filtering the signal in a waveguide path (block 915).

While the above embodiments have been discussed in terms of a diplexer, similar embodiments implemented as a tri-plexer, quad-plexer, etc., are possible and contemplated. In general, the discussion herein may be applied to splitters and combiners of any number of inputs/outputs that include at least one signal path implemented primarily using planar transmission lines and at least one signal path implemented primarily using a waveguide.

Numerous variations and modifications will become apparent to those skilled in the art once the above disclosure is fully appreciated. It is intended that the following claims be interpreted to embrace all such variations and modifications.

What is claimed is:

1. A diplexer comprising:

an input configured to receive a broadband signal, wherein the input is configured to couple to a first coaxial transmission line;

a first output, configured to couple to a second coaxial transmission line;

a low-pass filter configured to receive the broadband signal and further configured to provide a first output signal to the first output, wherein the first output is configured to convey the first output signal, and wherein the low-pass filter is implemented using a planar transmission line;

a second output, configured to couple to a third coaxial transmission line;

a high-pass filter configured to receive the broadband signal and to provide a second output signal to the second output, wherein the second output is configured to convey the second output signal, wherein the high-pass filter is implemented using a waveguide.

2. The diplexer as recited in claim 1, wherein the planar transmission line is a microstrip transmission line.

3. The diplexer as recited in claim 1, wherein the waveguide is a transverse electric (TE) mode E-plane waveguide.

4. The diplexer as recited in claim 1, further comprising a first suspended strip line (SSL) transmission line coupled between the input and the waveguide, and a second SSL transmission line coupled between the waveguide and the second output.

5. The diplexer as recited in claim 1, wherein the diplexer is configured to:

pass signals in a first frequency range, the first frequency range including signals having a frequency less than a cutoff frequency of the low-pass filter; and pass signals in a second frequency range, the second frequency range including signals having a frequency greater than a cutoff frequency of the high-pass filter;

wherein the first and second frequency ranges are overlapping.

6. The diplexer as recited in claim 1, wherein the diplexer is configured to:

pass signals in a first frequency range, the first frequency range including signals having a frequency less than a cutoff frequency of the low-pass filter; and pass signals in a second frequency range, the second frequency range including signals having a frequency greater than a cutoff frequency of the high-pass filter;

wherein the first and second frequency ranges are non-overlapping.

7. The diplexer as recited in claim 1, wherein the planar transmission line is a suspended strip line (SSL) transmission line.

8. A diplexer comprising:

a first port;

a second port;

a third port;

a first signal path coupled between the first port and the second port, wherein the first signal path is implemented using a planar transmission line; and a second signal path coupled between the first port and the third port, wherein the second signal path is implemented using a waveguide;

wherein at least one of the first and second signal paths implements a bandpass filter.

9. The diplexer as recited in claim 8, wherein the planar transmission line is a suspended strip line (SSL) transmission line.

10. The diplexer as recited in claim 9, wherein the third port implements a waveguide port or waveguide output using a coaxial transmission line.

11. A method comprising:

receiving, at an input of a diplexer, a broadband signal, via a first coaxial transmission line;

low-pass filtering the broadband signal using a low-pass filter implemented in the diplexer using a planar transmission line;

providing a first output signal from the low-pass filter via a second coaxial transmission line; high-pass filtering the broadband signal using a high-pass filter implemented in the diplexer using a waveguide; and providing a second output signal from the high-pass filter via a third coaxial transmission line.

12. The method as recited in claim 11, wherein the planar transmission line is a suspended strip line (SSL) transmission line, and wherein the waveguide is a transverse electric (TE) mode E-plane waveguide.

13. The method as recited in claim 11, further comprising:

passing signals in a first frequency range through the low-pass filter; and passing signals in a second frequency range through the high-pass filter;

wherein respective cutoff frequencies for the low-pass and high-pass filters are such that the first and second frequency ranges collectively form a contiguous range of frequencies.

14. The method as recited in claim 11, further comprising:

passing signals in a first frequency range through the low-pass filter; and passing signals in a second frequency range through the high-pass filter;

wherein a cutoff frequency of the low-pass filter is less than a cutoff frequency of the high pass filter, and wherein a frequency range formed by the first and second frequency ranges is non-contiguous.

15. A diplexer comprising:

a first port;

a second port;

wherein the first and second ports are implemented using coaxial transmission lines;

a third port;

a first signal path coupled between the first port and the second port, wherein the first signal path is implemented using a planar transmission line; and a second signal path coupled between the first port and the third port, wherein the second signal path is implemented using a waveguide.

16. The diplexer as recited in claim 15, wherein the planar transmission line is a suspended strip line (SSL) transmission line.

17. The diplexer as recited in claim 15, wherein the waveguide is a transverse electric (TE) mode E-plane waveguide.

18. The diplexer as recited in claim 15, wherein at least one of the first and second signal paths implements a bandpass filter.

19. The diplexer as recited in claim 15, wherein the third port implements a waveguide port or waveguide output using a coaxial transmission line.

20. A diplexer comprising:

an input configured to receive a broadband signal;

a low-pass filter configured to receive the broadband signal and further configured to provide a first output signal to a first output, wherein the low-pass filter is implemented using a planar transmission line;

a high-pass filter configured to receive the broadband signal and to provide a second output signal to a second output, wherein the high-pass filter is implemented using a waveguide;

wherein the diplexer is configured to:

pass signals in a first frequency range, the first frequency range including signals having a frequency less than a cutoff frequency of the low-pass filter; and pass signals in a second frequency range, the second frequency range including signals having a frequency greater than a cutoff frequency of the high-pass filter; and wherein the first and second frequency ranges are overlapping.

21. The diplexer as recited in claim 20, wherein the waveguide is a transverse electric (TE) mode E-plane waveguide.

22. The diplexer as recited in claim 20, wherein the diplexer further includes a first output configured to convey the first output signal, and a second output configured to convey the second output signal.

23. The diplexer as recited in claim 22, wherein the input is configured to couple to a coaxial transmission line, and wherein the first and second outputs are each configured to couple to coaxial transmission lines.

24. The diplexer as recited in claim 23, further comprising a first suspended strip line (SSL) transmission line coupled between the input and the waveguide, and a second SSL transmission line coupled between the waveguide and the second output.

25. The diplexer as recited in claim 20, wherein the planar transmission line is a suspended strip line (SSL) transmission line.

26. The diplexer as recited in claim 20, wherein the planar transmission line is a microstrip transmission line.

27. A diplexer comprising:

an input configured to receive a broadband signal;

a low-pass filter configured to receive the broadband signal and further configured to provide a first output signal to a first output, wherein the low-pass filter is implemented using a planar transmission line; and a high-pass filter configured to receive the broadband signal and to provide a second output signal to a second output, wherein the high-pass filter is implemented using a waveguide, wherein the waveguide is a transverse electric (TE) mode E-plane waveguide.

28. The diplexer as recited in claim 27, wherein the planar transmission line is a microstrip transmission line.

29. The diplexer as recited in claim 27, wherein the diplexer further includes the first output configured to convey the first output signal, and the second output configured to convey the second output signal.

30. The diplexer as recited in claim 27, wherein the input is configured to couple to a coaxial transmission line, and wherein the first and second outputs are each configured to couple to coaxial transmission lines.

31. The diplexer as recited in claim 30, further comprising a first suspended strip line (SSL) transmission line coupled between the input and the waveguide, and a second SSL transmission line coupled between the waveguide and the second output.

32. The diplexer as recited in claim 27, wherein the diplexer is configured to:

pass signals in a first frequency range, the first frequency range including signals having a frequency less than a cutoff frequency of the low-pass filter; and pass signals in a second frequency range, the second frequency range including signals having a frequency greater than a cutoff frequency of the high-pass filter;

wherein the first and second frequency ranges are overlapping.

33. The diplexer as recited in claim 27, wherein the diplexer is configured to:

pass signals in a first frequency range, the first frequency range including signals having a frequency less than a cutoff frequency of the low-pass filter; and pass signals in a second frequency range, the second frequency range including signals having a frequency greater than a cutoff frequency of the high-pass filter;

wherein the first and second frequency ranges are non-overlapping.

34. The diplexer as recited in claim 27, wherein the planar transmission line is a suspended strip line (SSL) transmission line.

35. A diplexer comprising:

a first port;

a second port;

a third port;

a first signal path coupled between the first port and the second port, wherein the first signal path is implemented using a planar transmission line; and a second signal path coupled between the first port and the third port, wherein the second signal path is implemented using a waveguide, wherein the waveguide is a transverse electric (TE) mode E-plane waveguide.

36. The diplexer as recited in claim 35, wherein at least one of the first and second signal paths implements a bandpass filter.

37. The diplexer as recited in claim 35, wherein the planar transmission line is a suspended strip line (SSL) transmission line.

38. The diplexer as recited in claim 37, wherein the third port implements a waveguide port or waveguide output using a coaxial transmission line.

* * * * *